US007567032B2

(12) United States Patent
Choi et al.

(10) Patent No.: US 7,567,032 B2
(45) Date of Patent: Jul. 28, 2009

(54) PLASMA DISPLAY PANEL AND MANUFACTURING METHOD OF THE SAME

(75) Inventors: Hoon-Young Choi, Suwon-si (KR); Takahisa Mizuta, Suwon-si (KR); Jae-Rok Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 542 days.

(21) Appl. No.: 11/319,575

(22) Filed: Dec. 29, 2005

(65) Prior Publication Data

US 2006/0214582 A1 Sep. 28, 2006

(30) Foreign Application Priority Data

Mar. 24, 2005 (KR) ..... 10-2005-0024488

(51) Int. Cl.
*H01J 17/49* (2006.01)

(52) U.S. Cl. ..... 313/582

(58) Field of Classification Search ..... 313/582–587, 313/494; 445/24

See application file for complete search history.

(56) References Cited

U.S. PATENT DOCUMENTS

| | | | | |
|---|---|---|---|---|
| 5,742,122 | A * | 4/1998 | Amemiya et al. | 313/582 |
| 6,650,062 | B2 | 11/2003 | Inoue et al. | |
| 7,067,979 | B2 | 6/2006 | Sakamoto | |
| 2002/0179579 | A1 | 12/2002 | Lin et al. | |
| 2003/0080683 | A1 | 5/2003 | Inoue et al. | |
| 2004/0245929 | A1 * | 12/2004 | Sakamoto | 313/584 |
| 2005/0007018 | A1 | 1/2005 | Akiba | |

FOREIGN PATENT DOCUMENTS

| | | |
|---|---|---|
| EP | 0 739 026 | 10/1996 |
| JP | 07-230756 A | 8/1995 |
| JP | 08-339766 A | 12/1996 |
| JP | 11-233010 A | 8/1999 |
| JP | 2000-331615 | 11/2000 |
| JP | 2003-132804 A | 5/2003 |
| JP | 2003-208853 A | 7/2003 |

OTHER PUBLICATIONS

Patent Abstracts of Japan, vol. 1998, No. 30, Nov. 30, 1998 & JP 10 214 569, Yamaguchi, et al, Nov. 8, 1998.

* cited by examiner

*Primary Examiner*—Toan Ton
*Assistant Examiner*—Hana A Sanei
(74) *Attorney, Agent, or Firm*—Lee & Morse, P.C.

(57) ABSTRACT

A plasma display panel includes a first and second substrates disposed facing each other, an address electrode formed on the first substrate and extending in a first direction, a first dielectric layer covering the address electrode, a second dielectric layer on the first dielectric layer, a first electrode and a second electrode alternately disposed on the second dielectric layer and extending in a second direction, a third dielectric layer covering the first electrode and the second electrode, a discharge space, the discharge space having a bottom defined by the first dielectric layer at a bottom of the discharge space and sidewalls defined by the second and third dielectric layers, and a phosphor layer in the discharge space.

14 Claims, 9 Drawing Sheets

PLASMA DISPLAY PANEL AND MANUFACTURING METHOD OF THE SAME

BACKGROUND OF THE INVENTION

1. Field of the Invention

The present invention relates to a plasma display panel (PDP) having an opposing discharge structure. More particularly, the present invention relates to a PDP that may be easily formed, has high light transmittance and luminescence efficiency, and a manufacturing method thereof.

2. Description of the Related Art

In a conventional plasma display panel (PDP), a rear substrate and a front substrate are assembled facing each other, an inert gas is filled in a discharge space between the rear substrate and the front substrate, and glow discharge is generated in the discharge space.

In more detail, the rear substrate is provided by forming an address electrode on a rear substrate, covering the address electrode with a dielectric layer, forming a barrier rib on the dielectric layer and forming a phosphor layer within the areas bounded by the barrier rib. Additionally, the front substrate facing the rear substrate is provided by forming an electrode pair having a sustain electrode and a scan electrode on a front substrate, the electrode pair being orthogonal to the address electrode, and covering the electrode pair with a stacked structure including a dielectric layer and a protective layer.

The PDP generates plasma from the glow discharge in the discharge space. Vacuum ultraviolet (VUV) rays are generated by the plasma, and the phosphor is excited by the VUV rays. Subsequently an image is displayed using red, green and blue light generated by the phosphor.

The sustain electrodes and the scan electrodes formed on the front substrate of the PDP are typically opaque. Accordingly, visible light emitted by the phosphor is blocked by the sustain electrodes and the scan electrodes, decreasing light transmittance. When a PDP has a surface discharge structure, high voltage is required and luminescence efficiency is low during sustain discharge. In order to overcome these problems, a PDP having an opposing discharge structure is required, as the following operational explanation illustrates.

Glow discharge is generated by applying a voltage, higher than discharge firing voltage, between two electrodes. Once the discharge is generated, voltage distribution between a cathode and an anode has a distorted form due to a space charge effect generated on the dielectric layer in the periphery of the cathode and the anode. That is, regions of a cathode sheath, an anode sheath, and a positive column are formed between the two electrodes. Most of the voltage applied to the two electrodes for the discharge is consumed in the cathode sheath region in the periphery of the cathode. A portion of the voltage is consumed in the anode sheath region in the periphery of the anode. The positive column region is formed between the cathode sheath region and the anode sheath region, and consumes negligible voltage.

A PDP having an opposing discharge structure increases a positive column generated between an anode sheath and a cathode sheath during glow discharge, thus improving luminescence efficiency compared to a PDP having a surface discharge structure.

The above information disclosed in this background section is only for enhancement of understanding of the background of the invention and therefore may contain information that does not form prior art known to a person of ordinary skill in the art.

SUMMARY OF THE INVENTION

The present invention is directed to a plasma display panel (PDP) and a manufacturing method thereof, which substantially overcome one or more of the problems due to the limitations and disadvantages of the.

It is a feature of an embodiment of the present invention to provide a PDP and a manufacturing method thereof allowing easy formation of an opposing discharge structure of a sustain electrode and a scan electrode.

It is another feature of an embodiment of the present invention to provide a PDP and a manufacturing method thereof having high luminescence efficiency and light transmittance.

At least one of the above and other features and advantages of the present invention may be realized by providing a PDP including a first substrate, an address electrode formed on the first substrate and extending in a first direction, a first dielectric layer covering the address electrode, a second dielectric layer on the first dielectric layer, a first electrode and a second electrode alternately disposed on the second dielectric layer and extending in a second direction, a third dielectric layer covering the first electrode and the second electrode, a discharge space, the discharge space having a bottom defined by the first dielectric layer at a bottom of the discharge space and sidewalls defined by the second and third dielectric layers, and a phosphor layer in the discharge space.

A first photosensitive material layer may be between the first dielectric layer and the second dielectric layer. The second direction may be orthogonal to the first direction and the first photosensitive material layer may be where the second dielectric layer intersects the address electrode. A width of the first photosensitive material layer may be substantially coextensive with a width of the second dielectric layer, the widths being measured in the first direction.

The second dielectric layer may include a first member disposed between adjacent address electrodes and extending in the first direction and a second member orthogonal to and crossing the address electrode. The third dielectric layer may include a third member corresponding to the first member and a fourth member crossing the third member and corresponding to the second member.

The third dielectric layer may have a protective layer formed thereon inside the discharge space. The protective layer may be opaque. The second dielectric layer and the third dielectric layer may be formed of a same dielectric material. The address electrode, the first electrode, and the second electrode may be formed of a conductive, opaque material. In a cross-section of the first electrode and the second electrode, a dimension in a horizontal direction of the first electrode and the second electrode may be less than a dimension in a vertical direction. The distance from the first substrate to the first dielectric layer corresponding to the address electrode may be greater than the distance from the first substrate to the first dielectric layer disposed adjacent to the second dielectric layer in parallel with the address electrode. A groove being adjacent to a sidewall of the sidewalls of the discharge space may be in the first dielectric layer. The groove may be parallel to the address electrode.

At least one of the above and other features and advantages of the present invention may be realized by providing a method of manufacturing a PDP including forming an address electrode on a first substrate, forming a first dielectric layer on the address electrode, forming a first photosensitive material layer on the first dielectric layer, forming a second dielectric film on the first photosensitive material layer, forming alternating first and second electrodes on the second dielectric layer, forming a third dielectric film on the first and second electrodes, forming a second photosensitive material layer on a third dielectric layer, the second photosensitive material being patterned to cover the first electrode and the second electrode, forming a discharge space by etching the second dielectric layer and the third dielectric layer to the first photosensitive material layer using the patterned second photosensitive material layer as a mask and forming a phosphor layer inside the discharge space.

Forming the discharge space may include sandblasting. Forming the phosphor layer further may include applying phosphor to an inner surface of the second dielectric layer forming the discharge space, and to a surface of the first dielectric layer partitioned by the second dielectric layer. The method may further include forming a protective layer on sidewalls of the third dielectric layer. Before forming the phosphor layer and after forming the discharge space, the first photosensitive material layer and the second photosensitive material layer may be removed.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
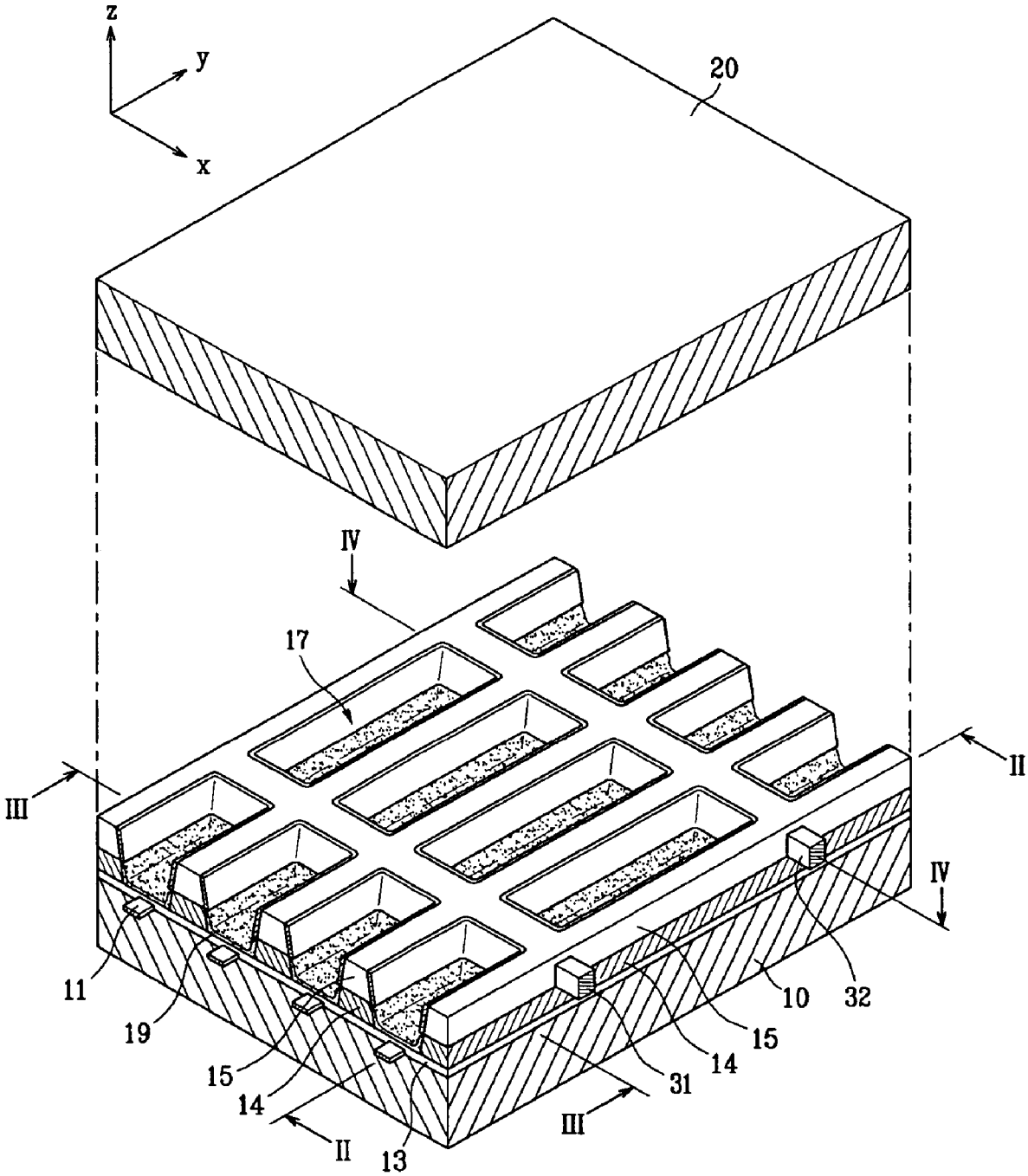
FIG. 1 illustrates a partial exploded perspective view of a PDP according to an exemplary embodiment of the present invention.

Korean Patent Application No. 10-2005-0024488, filed on Mar. 24, 2005, in the Korean Intellectual Property Office, and entitled: "Plasma Display Panel and Manufacturing Method of the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
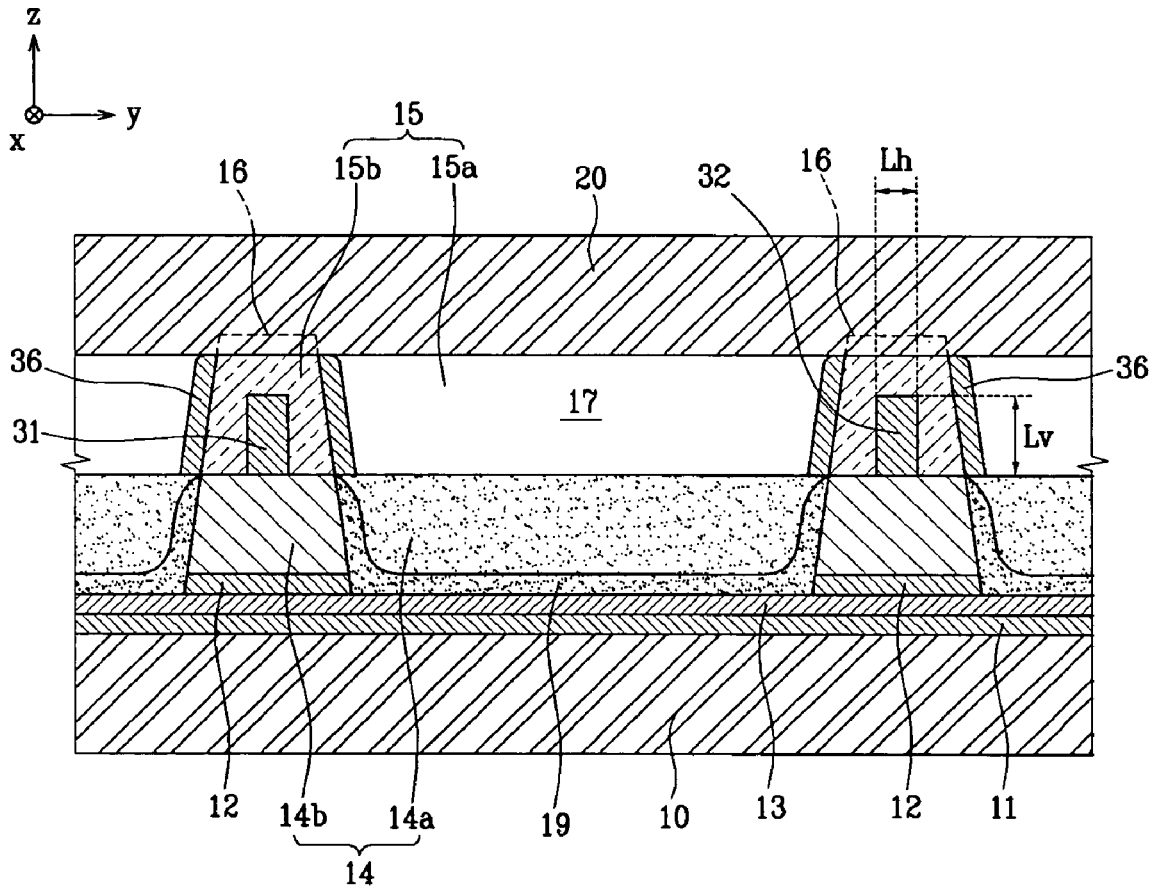
FIG. 2 illustrates a vertical cross-sectional view taken along the line II-II of FIG. 1.
Figure 3:
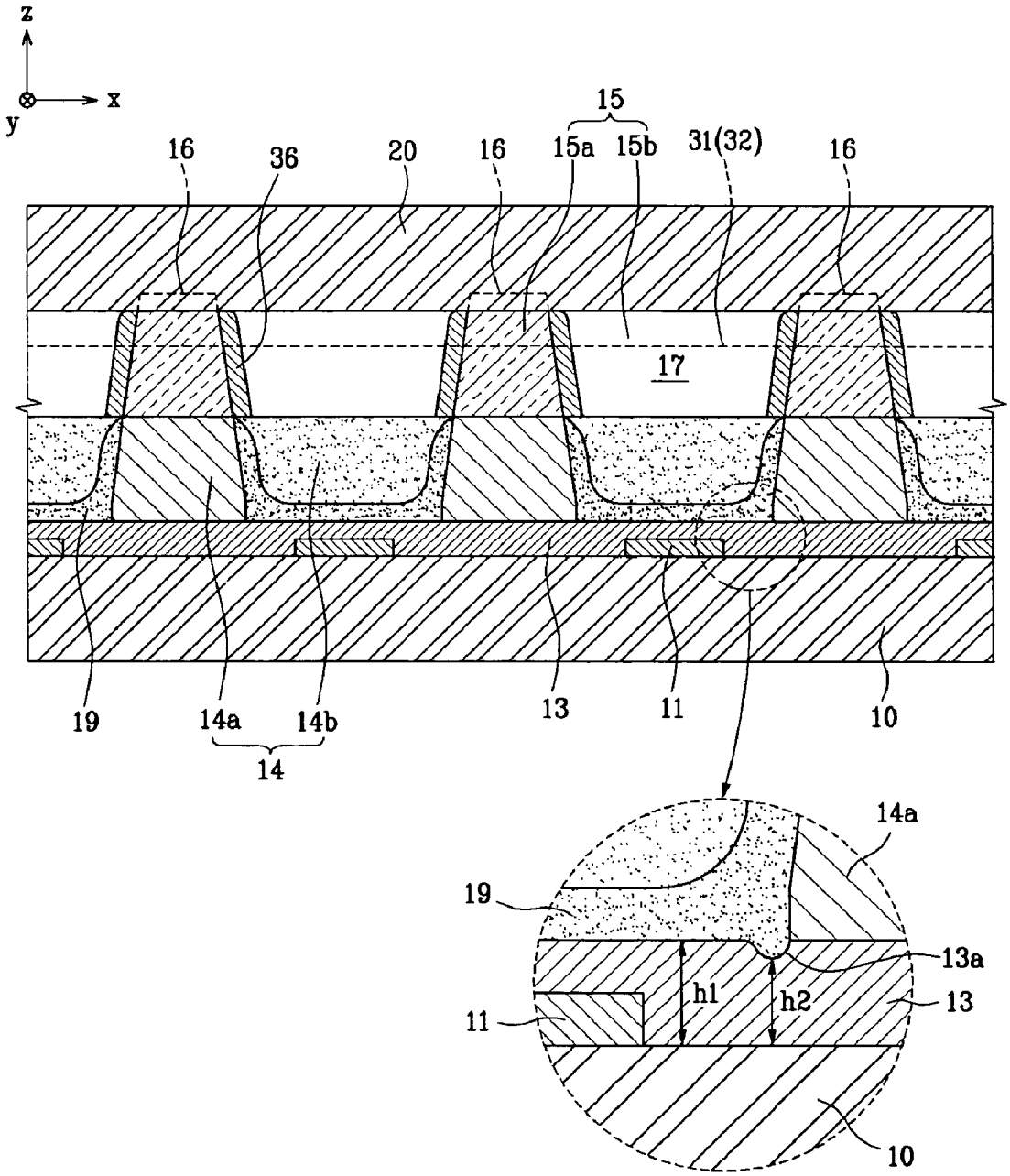
FIG. 3 illustrates a vertical cross-sectional view taken along the line III-III of FIG. 1.
Figure 4:
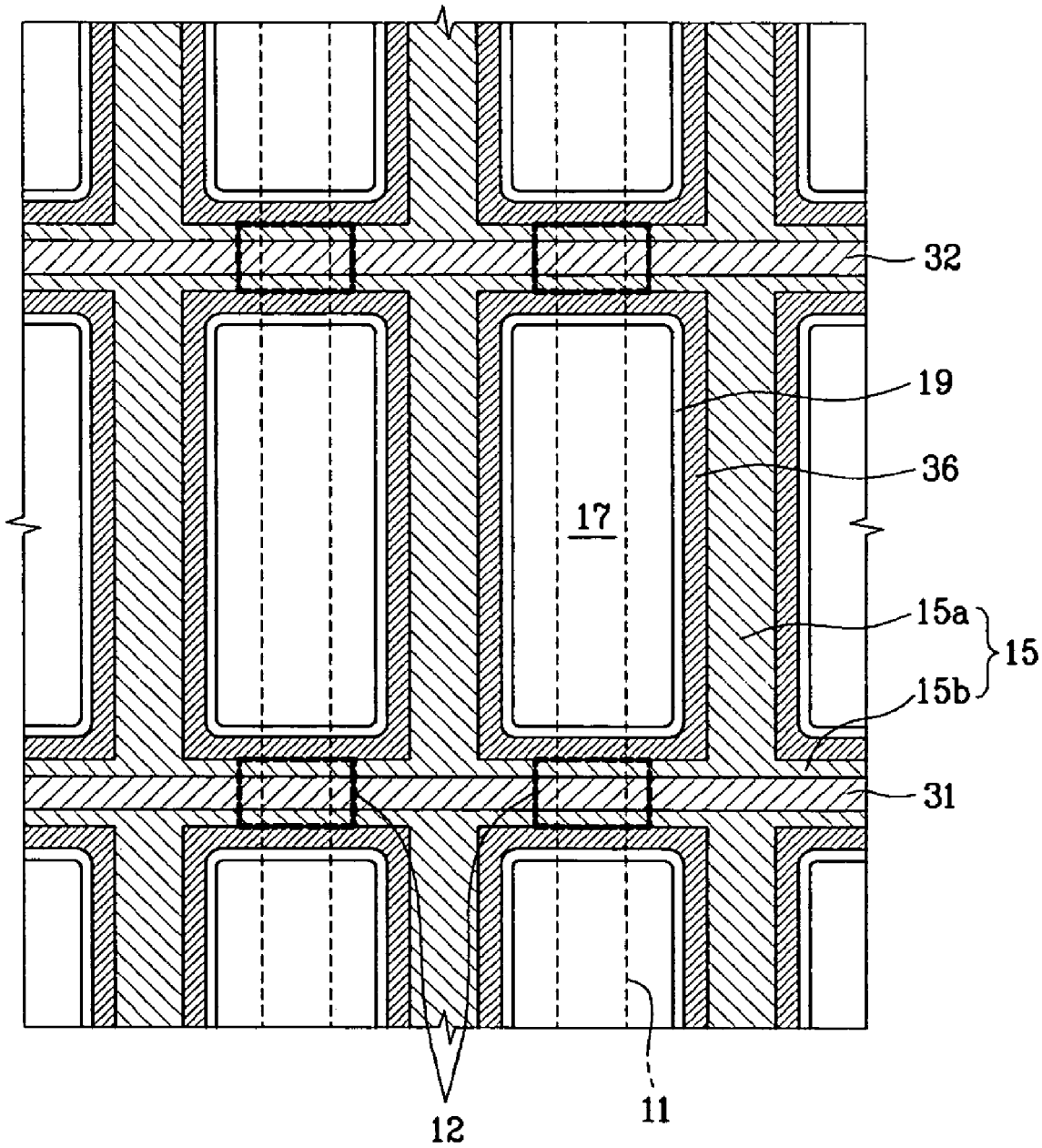
FIG. 4 illustrates a horizontal cross-sectional view taken along the line IV-IV of FIG. 1.

FIG. 1 illustrates a partial exploded perspective view of a PDP according to an embodiment of the present invention, FIG. 2 illustrates a vertical cross-sectional view taken along the line II-II of FIG. 1, FIG. 3 illustrates a vertical cross-sectional view taken along the line III-III of FIG. 1, and FIG. 4 illustrates a horizontal cross-sectional view taken along the line IV-IV of FIG. 1.

Referring to the FIGS. 1-4, the PDP according to an embodiment of the present invention may include a first substrate 10 (hereinafter called a "rear substrate") and a second substrate 20 (hereinafter called a "front substrate") disposed facing each other with a predetermined space therebetween. Additionally, a plurality of discharge spaces 17 may be formed between the rear substrate 10 and the front substrate 20. A phosphor layer 19 may be formed in the discharge space 17. A discharge gas, e.g., a gas mixture including neon (Ne) and xenon (Xe), may fill the discharge space 17. The phosphor layer 19 emits visible light after absorbing vacuum ultraviolet (VUV) rays generated by plasma discharge in the discharge gas.

An address electrode 11, a first electrode 31 (hereinafter, a "sustain electrode") and a second electrode 32 (hereinafter, a "scan electrode") may be disposed between the front substrate 20 and the rear substrate 10 to display an image. The address electrode 11 may be formed corresponding to each discharge space 17. The sustain electrode 31 and the scan electrode 32 may be disposed facing each other in a direction crossing the address electrode 11, corresponding to each discharge space 17. When an electrode crossing the address electrode 11 and generating an address discharge is additionally formed, the sustain electrode 31 and the scan electrode 32 may be formed in the direction parallel to the address electrode 11. Hereinafter, for convenience of explanation, a structure of the sustain electrode 31 and the scan electrode 32 crossing the address electrode 11 will be described as an example.

An address pulse may be applied to the address electrode 11 and a scan pulse may be applied to the scan electrode 32, generating address discharge. A discharge space 17 to be turned on may be selected by the address discharge. After the address discharge, a sustain pulse may be reciprocally applied to the sustain electrode 31 and the scan electrode 32, generating a sustain discharge. The sustain discharge displays an image in the selected discharge space 17. Additionally, after the sustain discharge, a reset pulse having a voltage higher than a sustain pulse may be applied to the scan electrode 32 such that the sustain electrode 31 may be biased with a reference voltage. Each discharge space 17 may be reset by the reset pulse. The present invention is not limited to the above description, since each electrode may act differently according to a voltage applied thereto.

The address electrode 11 may be formed on the inner surface of the rear substrate 10 and may extend in one direction, e.g., along a y-axis direction as shown in FIGS. 1-4. Additionally, the address electrode 11 may be covered by a first dielectric layer 13. The first dielectric layer 13 may also cover the remaining part of the rear substrate 10. The address electrode 11 may be disposed parallel to other adjacent address electrodes 11, maintaining a space therebetween along an x-axis direction as shown in FIGS. 1-4, i.e., corresponding to the discharge space 17.

A first photosensitive material layer 12 may be formed on the first dielectric layer 13. As shown in FIG. 4, the first photosensitive material layers 12 may be arranged with a predetermined spacing, corresponding to the address electrode 11. The first photosensitive material layer 12 may be covered by a second dielectric layer 14. The first photosensitive material layer 12 may protect the address electrode 11 from being etched. That is, when the discharge space 17 is being formed by etching the second dielectric layer 14 corresponding to the address electrode 11, the first photosensitive material layer 12 protects the address electrode 11 from being etched. Accordingly, the first photosensitive material layer 12 may be formed on the first dielectric layer 13 corresponding to the whole of the address electrodes 11. Additionally, a portion of the first photosensitive material layer 12 exposed to the etching may be removed after the etching.

Even when the portion exposed to the etching is removed, the first photosensitive material layer 12 remains where the address electrode 11 crosses the second dielectric layer 14, because the first photosensitive material layer 12 is covered by the second dielectric layer 14, as shown in FIG. 2. As shown in FIG. 2, in the cross-section cut in a plane parallel to the address electrode 11, i.e., the y-axis direction, and perpendicular to the rear substrate 10 and the front substrate 20, i.e., the z-axis direction, a width of the first photosensitive material layer 12 may be formed to be similar to a width of the second dielectric layer 14 partitioning the discharge space 17.

The second dielectric layer 14 may be formed on the first photosensitive material layer 12 and the first dielectric layer 13 where the first photosensitive material layer 12 is not formed. The second dielectric layer 14 may partition the discharge space 17. The second dielectric layer 14 may partition the discharge space 17 in a lattice form as shown in the FIGS. 1-4, or partition a discharge space in a stripe form (not shown). When the discharge space 17 is formed as a stripe, the second dielectric layer 14 may be formed only in a direction parallel to the first photosensitive material layer 12 (not shown).

When the discharge space 17 is in a lattice form as shown in FIG. 1-4, the second dielectric layer 14 may include a first member 14*a* and a second member 14*b*. The first member 14*a* may be disposed between the adjacent address electrodes 11 and may be elongated in parallel thereto. The second member 14*b* may be formed crossing the first member 14*a*, and corresponding to the sustain electrode 31 and the scan electrode 32. When the discharge space 17 is formed as a lattice, the second dielectric layer 14 may be formed in the y-axis direction parallel to the first photosensitive material layer 12, and formed in the x-axis direction crossing the first photosensitive material layer 12. Additionally, the second dielectric layer 14 may be formed by partially covering the first photosensitive material layer 12 at a part corresponding to the sustain electrode 31 and the scan electrode 32.

Referring to FIG. 3, a distance ($h_1$) from the rear substrate 10 to the first dielectric layer 13 corresponding to the address electrode 11 may be greater than a distance ($h_2$) from the rear substrate 10 to the first dielectric layer 13 formed at either edge of the discharge space 17. In other words, at the part corresponding to the address electrode 11, the distance from the rear substrate 10 to the bottom surface of the discharge space 17 may be greater than the distance from the rear substrate 10 to the bottom surface of the discharge space 17 adjacent to the first member 14*a*.

In more detail, the second dielectric layer 14 may be etched, e.g., by a sandblasting method, to form the discharge space 17. Due to the first photosensitive material layer 12, a part of the first dielectric layer 13 corresponding to the address electrode 11 is not affected by the etching. However, where the first photosensitive material layer 12 is not formed, i.e., at both edges of the discharge space 17, the first dielectric layer 13 may be affected by the sandblasting. Accordingly, after removing the first photosensitive material layer 12, a groove 13*a* may be formed on the bottom surface of both edges of the discharge space 17 in the first dielectric layer 13. The groove may be parallel and adjacent to the first member 14*a*. When the phosphor layer 19 is provided in the discharge space, it may fill the groove 13*a*.

The sustain electrode 31 and the scan electrode 32 may be disposed facing each other on the second dielectric layer 14. The sustain electrode 31 and the scan electrode 32 may be formed on the second member 14*b* and extend in the direction crossing the address electrode 11, i.e., the x-axis direction. Alternatively, though not shown, when another electrode crossing the address electrode is employed, the sustain electrode 31 and the scan electrode 32 may be disposed alternately on the first member 14*a*, along the direction parallel to the address electrode 11, i.e., the y-axis direction.

As shown in FIG. 2, in the cross-section of the sustain electrode 31 and the scan electrode 32, a dimension ($L_h$) in the direction parallel to the substrate may be less than a dimension ($L_v$) perpendicular to the substrate. With this structure, the facing area of the sustain electrode 31 and the scan electrode 32 is increased. Accordingly, an opposing discharge may be generated with a far lower voltage or a stronger discharge may be generated with the same voltage. That is, luminescence efficiency may be improved by the opposing discharge structure. Additionally, since the sustain electrode 31 and the scan electrode 32 are formed at both sides of the discharge space 17, light transmittance of the front substrate 20 may be improved.

Since the sustain electrode 31 and the scan electrode 32 are formed at both sides of the discharge space 17 and the address electrode 11 is formed at the rear substrate 10, visible light is not blocked by the electrodes. Accordingly, the electrodes may be formed of an opaque material having excellent electrical conductivity, e.g., a metal.

The sustain electrode 31 and the scan electrode 32 may be covered by the third dielectric layer 15. Additionally, a second photosensitive material layer 16 may be formed on the third dielectric layer 15. In FIG. 2 and FIG. 3, the second photosensitive material layer 16 is drawn with a dotted line for convenience of explanation. However, the second photosensitive material layer 16 may be removed before completing the final product.

The second photosensitive material layer 16 may protect the sustain electrode 31 and the scan electrode 32 from being etched. That is, like the first photosensitive material layer 12, when a discharge space 17 is formed between the sustain electrode 31 and the scan electrode 32 by etching the second dielectric layer 14 and the third dielectric layer 15, the second photosensitive material layer 16 protects the sustain electrode 31 and the scan electrode 32 from the etching. Accordingly, the second photosensitive material layer 16 may be used during a manufacturing process, and removed after etching the second dielectric layer 14 and the third dielectric layer 15.

The second photosensitive material layer 16 may be formed as a stripe (not shown) corresponding to the sustain electrode 31 and scan electrode 32, and may be removed after use. Alternatively, as shown in FIGS. 2 and 3, the second photosensitive material layer 16 may be formed as a lattice corresponding to the discharge space 17, and may be removed after use.

In the present embodiment, a structure having the third dielectric layer 15 formed as a lattice, the second photosensitive material layer 16 formed as a lattice, and the second photosensitive material layer 16 removed is shown as an example. That is, the third dielectric layer 15 may include a third member 15*a* corresponding to the first member 14*a* of the second dielectric layer 14, and a fourth member 15*b* crossing the third member 15*a* and corresponding to the second member 14*b*. The second dielectric layer 14 and the third dielectric layer 15 may be formed of the same dielectric material. In this case, the manufacturing process may be simplified by use of the same material.

The phosphor layer 19 may be formed on the inner surfaces of the first member 14*a* and the second member 14*b* of the second dielectric layer 14, and on the inner surface of the first dielectric layer 13 corresponding to the discharge space 17. The phosphor layer 19 may also be formed on the inner surfaces of the third member 15*a* and the fourth member 15*b* of the third dielectric layer 15 forming the discharge space 17 (not shown). As noted above, the phosphor layer 19 may fill the groove 13*a*.

When the phosphor layer 19 is not formed on the inner surfaces of the third dielectric layer 15, a protective layer 36 may be formed on the inner side surface of the third dielectric layer 15. The protective layer 36 may be formed at a part exposed to plasma discharge generated in the discharge space 17. The protective layer 36 may protect the third dielectric layer 15. The protective layer 36 requires a high secondary electron emission coefficient, but does not need to transmit visible light.

Thus, in the present embodiment, the sustain electrode 31 and the scan electrode 32 may not be formed on the front substrate 20, but may be formed between the substrates 10 and 20, and the protective layer 36 is formed on the third dielectric layer 15 covering the sustain electrode 31 and the scan electrode 32. Accordingly, the protective layer 36 may be formed of a material that is opaque to visible light, e.g., an opaque MgO. Opaque MgO has a far higher secondary electron emission coefficient than MgO that is transparent to visible light, thereby allowing the discharge firing voltage to be further decreased.

Figure 5:
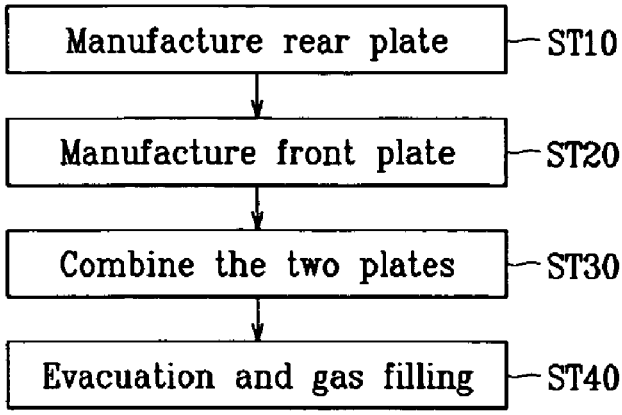
FIG. 5 illustrates a flow chart of a manufacturing process of a PDP according to an embodiment of the present invention.

FIG. 5 illustrates a flow chart showing a manufacturing process of a PDP according to an exemplary embodiment of the present invention, and FIG. 6 to FIG. 11 illustrate cross-sectional views of stages in a method of manufacturing of a rear substrate of a PDP according to an exemplary embodiment of the present invention.

Referring to FIGS. 5-11, a manufacturing method of a PDP having configurations as described above will be explained. Firstly, at step ST10, the rear substrate 10 is manufactured, and then, at step ST20, the second substrate 20 is separately manufactured. Electrodes, dielectric layers, and phosphor layers may be formed on the rear substrate 10. Details of forming elements on the rear substrate according to an embodiment of the present invention are shown in FIGS. 6-11.

At step ST30, the front substrate and the rear substrate may be combined and secured together. At step ST40, air may be evacuated from the discharge space 17 and a discharge gas, e.g. a mixed gas of Ne and Xe, fills the discharge space 17 to complete the PDP.

Figure 6:
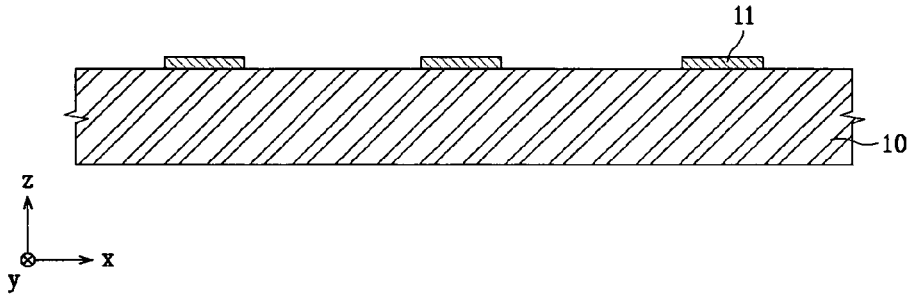
FIG. 6 to FIG. 11 illustrate cross-sectional views of stages in a method of manufacturing a rear substrate of the PDP according to an embodiment of the present invention.

As described above, the step ST10 of manufacturing the rear substrate may include forming the address electrode 11 as shown in FIG. 6.

Conventional methods, e.g., a pattern printing method or an exposing and developing method utilizing photosensitive paste, may be used to manufacture the address electrode 11.

Figure 7:
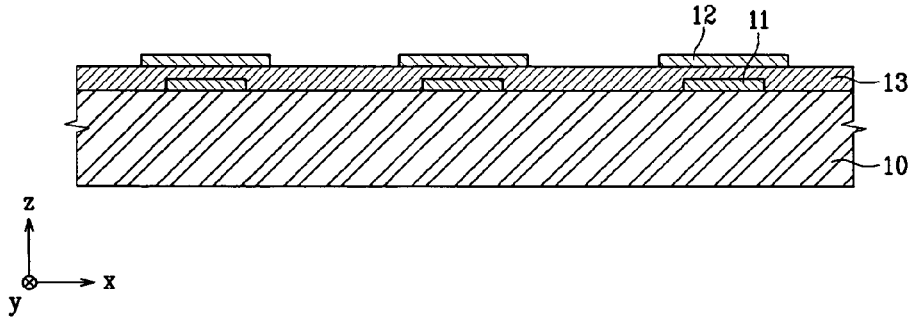

Referring to FIG. 7, the first dielectric layer 13 may be formed using a conventional printing method. The first photosensitive material layer 12 may be formed by providing a laminated film on the first dielectric layer 13. Subsequently, a patterning process may be performed by an exposure process so that the first photosensitive material layer 12 corresponding to the address electrode 11 remains.

Figure 8A:
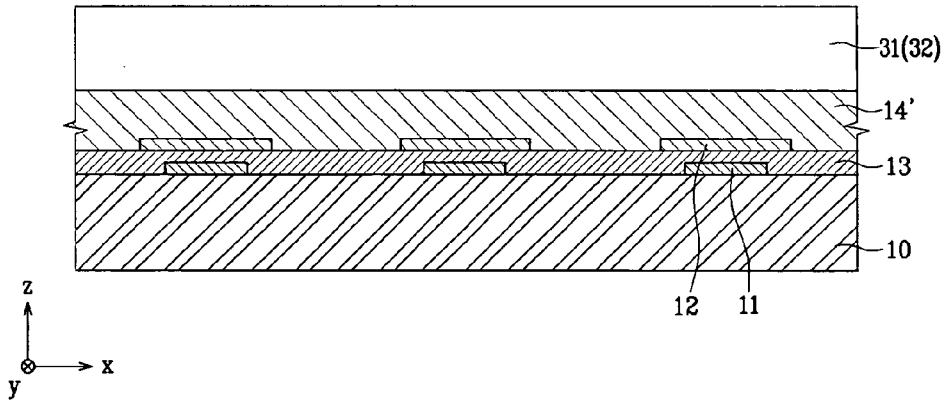
Figure 8B:
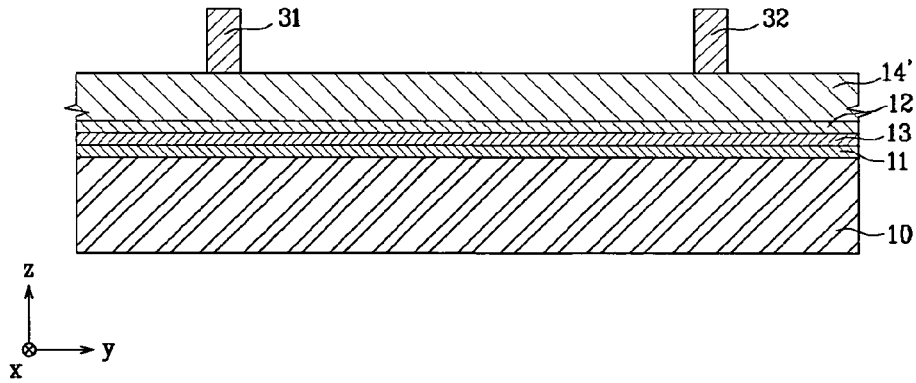

Referring to FIGS. 8A and 8B, a second dielectric film 14' may be formed on the first photosensitive material layer 12 and the first dielectric layer 13. The second dielectric film 14' may be formed by a conventional printing method. Subsequently, the sustain electrode 31 and the scan electrode 32 may be formed on the second dielectric film 14'. Accordingly, the first photosensitive material layer 12 may be spaced apart from the sustain electrode 31 and the scan electrode 32. The sustain electrode 31 and the scan electrode 32 may be formed in a predetermined electrode pattern using pattern printing or a photosensitive material for a metal electrode.

Figure 9A:
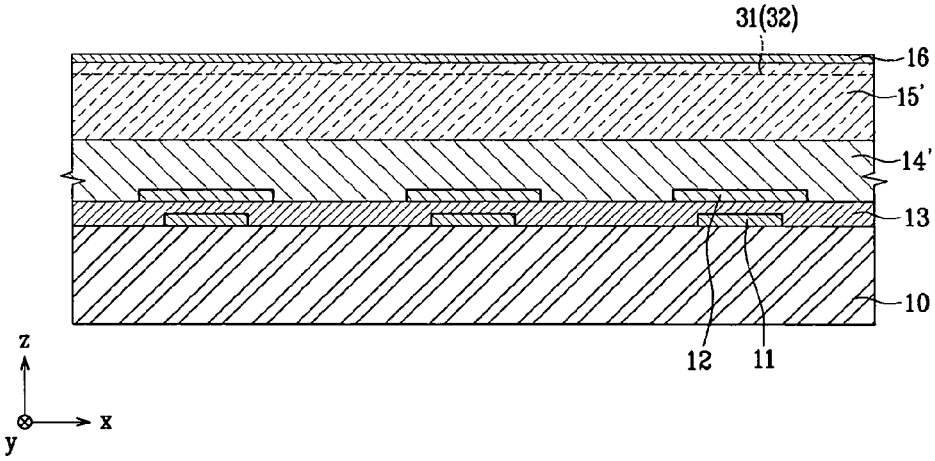
Figure 9B:
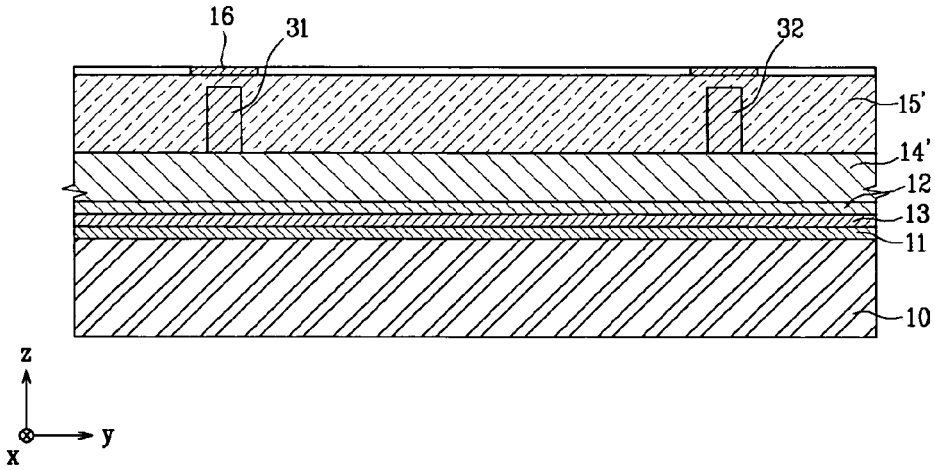

Subsequently, the sustain electrode 31 and the scan electrode 32 may be covered with a third dielectric film 15' and the second photosensitive material layer 16 may be formed thereon, as shown in FIGS. 9A and 9B. The third dielectric film 15' may cover the sustain electrode 31 and the scan electrode 32, and may be formed on a part corresponding to a barrier rib partitioning the discharge space 17. The third dielectric film 15' and the second dielectric film 14' may be patterned to form the discharge space 17. Thus, the discharge space 17 may be defined by a dielectric material instead of a conventional material for the barrier rib. The third dielectric film 15' may be formed on the second dielectric film 14' by coating the dielectric material. In forming the second photosensitive material layer 16, a second photosensitive material film may be laminated on the third dielectric film 15'. Subsequently, a patterning process may be performed by utilizing an exposure process so that the second photosensitive material layer 16 remains at regions of the third dielectric film 15' corresponding to the sustain electrode 31 and the scan electrode 32 as shown in FIG. 9B.

Figure 10:
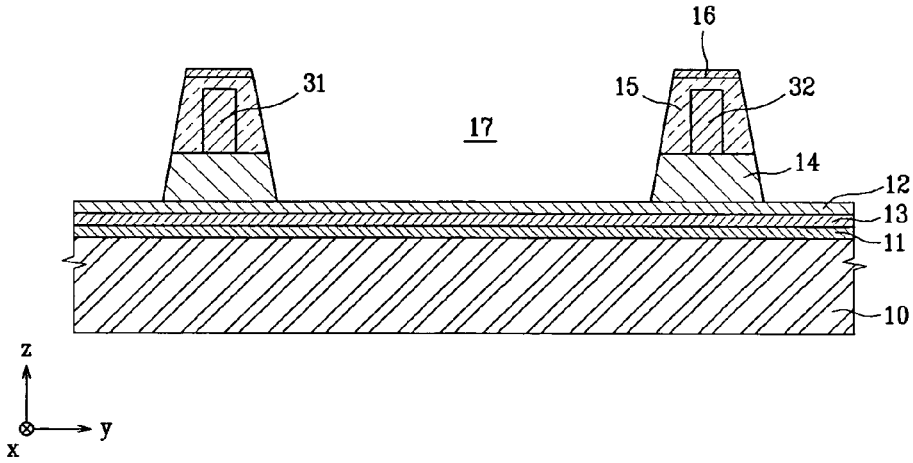

Referring to FIG. 10, in an embodiment of the present invention, by removing portions of the second dielectric film 14' and the third dielectric film 15', the discharge space 17 is partitioned by the remaining part of the second dielectric film 14' and the third dielectric film 15', i.e., the second dielectric layer 14 and the third dielectric layer 15. By using the second photosensitive material layer 16 as a mask and the first photosensitive material layer 12 as an etch stop, the second dielectric film 14' and the third dielectric film 15' may be removed to form the discharge space 17. The second photosensitive material layer 16 and the first photosensitive material layer 12 may be formed of a conventional laminated film for a barrier rib.

Thus, the discharge space 17 may be formed by etching, e.g., using sandblasting the second dielectric film 14' and the third dielectric film 15'. After such etching, part of the second dielectric film 14' and the third dielectric film 15' not covered by the second photosensitive material layer 16, may be removed, i.e., the second photosensitive material layer 16 serves as a mask. By such removal, the first photosensitive material layer 12 may be exposed between the second dielectric layer 14 and the third dielectric layer 15, and the discharge space 17 may be formed. The first photosensitive material layer 12 may protect the first dielectric layer 13 and address electrode 11 from being removed during the etching, i.e., the first photosensitive material layer 12 serves as an etch stop.

As described above, the sustain electrode 31 and scan electrode 32 may be formed on a partitioned location of the discharge space 17, and the discharge space 17 may be formed by etching the second dielectric layer 14 and the third dielectric layer 15 covering the sustain electrode 31 and the scan electrode 32. Accordingly, an opposing discharge structure of the sustain electrode 31 and the scan electrode 32 may be formed easily.

Figure 11:
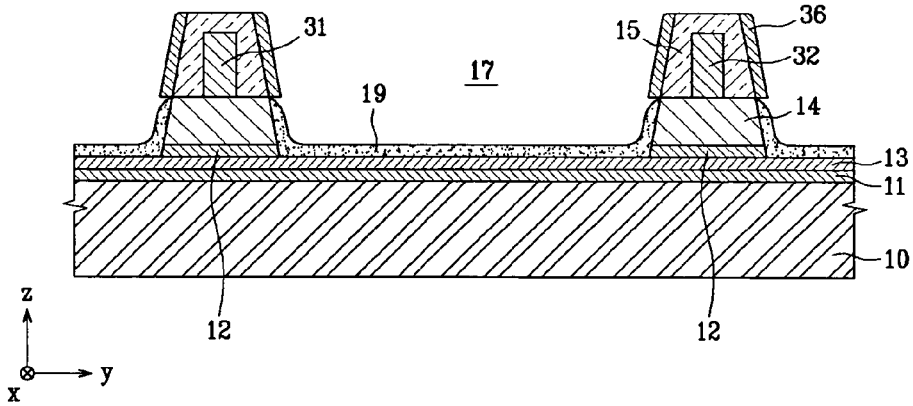

Subsequently, any of the first photosensitive material layer 12 and the second photosensitive material layer 16 exposed by the etching may be removed, and the phosphor layer 19 may be formed inside the discharge space 17, as shown in FIG. 11. The phosphor layer 19 may be formed by coating a phosphor, exposing and developing the phosphor. Phosphor may be applied to the inner surface of the second dielectric layer 14 partitioning the discharge space 17. Additionally, the phosphor may be applied to the inner surface of the second dielectric layer 14 and to the inner surface of the third dielectric layer 15.

The manufacturing method of a PDP according to an exemplary embodiment of the present invention may further include forming the protective layer 36 on the inner surface of the third dielectric layer 15, as shown in FIG. 11. That is, when the phosphor layer 19 is not formed on the inner surface of the third dielectric layer 15, a protective layer 36 may be formed thereon.

As described above, according to an exemplary embodiment of the present invention, an address electrode may be formed on a rear substrate, and a first photosensitive material layer may be formed on a first dielectric layer covering the address electrode. Additionally, a second dielectric layer may be formed on the first dielectric layer and the first photosensitive material layer, a first electrode and a second electrode may be formed on the second dielectric layer in an opposing discharge structure, and a second photosensitive material layer may be formed on a third dielectric layer covering the first electrode and the second electrode. Accordingly, regions of the second dielectric layer and the third dielectric layer on which a second photosensitive material layer is not formed are etched to the first photosensitive material layer, and thereby a discharge space is formed. Additionally, since the first photosensitive material layer and the second photosensitive material layer exposed to etching may be removed, the opposing discharge structure of the first electrode and the second electrode may be formed easily. Additionally, luminescence efficiency may be improved by the opposing discharge structure, and light transmittance may be improved by forming the first electrode and the second electrode at sides of the discharge space.

Exemplary embodiments of the present invention have been disclosed herein, and although specific terms are employed, they are used and are to be interpreted in a generic and descriptive sense only and not for purpose of limitation. For example, while the first photosensitive layer is disclosed as a patterned layer, the first photosensitive layer may cover the first dielectric layer in its entirety. Accordingly, it will be understood by those of ordinary skill in the art that various changes in form and details may be made without departing from the spirit and scope of the present invention as set forth in the following claims.

What is claimed is:

1. A plasma display panel, comprising:

a first substrate;

an address electrode formed on the first substrate and extending in a first direction;

a first dielectric layer covering the address electrode;

a second dielectric layer on the first dielectric layer;

a first electrode and a second electrode alternately disposed on the second dielectric layer and extending in a second direction;

a third dielectric layer covering the first electrode and the second electrode;

a discharge space, the discharge space having a bottom defined by the first dielectric layer at a bottom of the discharge space and sidewalls defined by the second and third dielectric layers;

a phosphor layer in the discharge space; and a first photosensitive material layer between the first dielectric layer and the second dielectric layer.

2. The plasma display panel as claimed in claim 1, wherein the second direction is orthogonal to the first direction and the first photosensitive material layer is where the second dielectric layer intersects the address electrode.

3. The plasma display panel as claimed in claim 1, wherein a width of the first photosensitive material layer is substantially coextensive with a width of the second dielectric layer, the widths being measured in the first direction.

4. The plasma display panel as claimed in claim 1, wherein the second dielectric layer includes a first member disposed between adjacent address electrodes and extending in the first direction and a second member orthogonal to and crossing the address electrode.

5. The plasma display panel as claimed in claim 4, wherein the third dielectric layer includes a third member corresponding to the first member and a fourth member crossing the third member and corresponding to the second member.

6. The plasma display panel as claimed in claim 1, wherein the third dielectric layer has a protective layer formed thereon inside the discharge space.

7. The plasma display panel as claimed in claim 6, wherein the protective layer is opaque.

8. The plasma display panel as claimed in claim 1, wherein the second dielectric layer and the third dielectric layer are formed of a same dielectric material.

9. The plasma display panel as claimed in claim 1, wherein the address electrode, the first electrode, and the second electrode are formed of a conductive, opaque material.

10. The plasma display panel as claimed in claim 1, wherein, in a cross-section of the first electrode and the second electrode, a dimension in a horizontal direction of the first electrode and the second electrode is less than a dimension in a vertical direction.

11. The plasma display panel as claimed in claim 1, wherein the distance from the first substrate to the first dielectric layer corresponding to the address electrode is greater than the distance from the first substrate to the first dielectric layer disposed adjacent to the second dielectric layer in parallel with the address electrode.

12. The plasma display panel as claimed in claim 1, further comprising a groove in the first dielectric layer, the groove being adjacent to a sidewall of the sidewalls of the discharge space.

13. The plasma display panel as claimed in claim 12, wherein the groove is parallel to the address electrode

14. The plasma display panel as claimed in claim 1, wherein the first direction is orthogonal to the second direction, and the second dielectric layer crosses the address electrode.

* * * * *